US008439133B2

(12) United States Patent
Zulak et al.

(10) Patent No.: US 8,439,133 B2
(45) Date of Patent: May 14, 2013

(54) DOWN HOLE APPARATUS FOR GENERATING A PUSLING ACTION

(75) Inventors: Mike Zulak, Spruce Grove (CA); Dave Kutinsky, Edmonton (CA)

(73) Assignee: Nighthawk Energy Services Canada Ltd., Edmonton, Alberta (CA)

( * ) Notice: Subject to any disclaimer, the term of this patent is extended or adjusted under 35 U.S.C. 154(b) by 347 days.

(21) Appl. No.: 12/987,372

(22) Filed: Jan. 10, 2011

(65) Prior Publication Data

US 2012/0073878 A1 Mar. 29, 2012

(51) Int. Cl.
*E21B 4/02* (2006.01)

(52) U.S. Cl.
USPC ..... 175/317; 175/107

(58) Field of Classification Search ..... 175/317, 175/324, 107; 166/178
See application file for complete search history.

(56) References Cited

U.S. PATENT DOCUMENTS

| | | | | |
|---|---|---|---|---|
| 2,947,180 | A | 8/1960 | Oros | |
| 3,363,700 | A | 1/1968 | Bogusch, Jr. | |
| 3,824,362 | A | 7/1974 | Bury | |
| 4,082,152 | A | 4/1978 | Whitworth | |
| 5,927,585 | A | 7/1999 | Moorman et al. | |
| 6,279,670 | B1 * | 8/2001 | Eddison et al. | 175/107 |
| 6,508,317 | B2 | 1/2003 | Eddison et al. | |
| 2011/0031020 | A1 * | 2/2011 | Cote | 175/56 |

* cited by examiner

*Primary Examiner* — David Bagnell
*Assistant Examiner* — Suleiman Ibrahim
(74) *Attorney, Agent, or Firm* — Davis & Bujold, PLLC

(57) ABSTRACT

A down hole apparatus for generating a pulsing action includes a tubular housing a rotating first mandrel with a first cam profile and a reciprocating second mandrel with a second cam profile, which engages the first cam profile. Upon rotational movement of the first mandrel, the first cam profile exerts an axial force upon the second cam profile to initiate a pulsing action by forcing the second mandrel away from the first mandrel. Springs bias the second mandrel back toward the first mandrel, thereby completing the pulsing action and maintaining the second cam profile engaged with the first cam profile.

2 Claims, 4 Drawing Sheets

DOWN HOLE APPARATUS FOR GENERATING A PUSLING ACTION

FIELD

There is described a down hole apparatus that generates a pulsing action which is transmitted to a drill bit to avoid becoming struck in a horizontal well.

BACKGROUND

U.S. Pat. No. 6,508,317 (Eddison et al) describes a down hole apparatus that generates a pulsing action, which is transmitted to a drill bit to avoid becoming stuck in a horizontal well. The manner of generating the pulsing action is to incorporate into the down hole apparatus a pressure responsive device, which expands or retracts in response to varying flow pressure. The apparatus which will hereinafter be described generates a similar pulsing action using an alternative technology.

SUMMARY

There is provided a down hole apparatus for generating a pulsing action, including a tubular housing having a first end, a second end, and an interior surface defining an interior bore. The interior surface of the housing has an interior axial engagement at the second end. A first mandrel is provided having a first end and a second end. The first mandrel is journalled for rotation within the interior bore at the first end of the housing. The second end of the first mandrel has a first cam profile. A second mandrel is provided having a first end, a second end and an exterior surface having an exterior axial engagement. The second mandrel is positioned within the interior bore of the housing with the exterior axial engagement engaged with the interior axial engagement on the interior surface of the housing with the second mandrel unable to rotate but able to move axially relative to the housing. The first end of the second mandrel has a second cam profile, which engages the first cam profile. Upon rotational movement of the first mandrel, the first cam profile exerts an axial force upon the second cam profile forcing the second mandrel away from the first mandrel. Springs are positioned between an interior shoulder on the interior surface of the housing and an exterior shoulder on the second mandrel to apply a force biasing the second mandrel toward the first mandrel, thereby maintaining the second cam profile engaged with the first cam profile.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
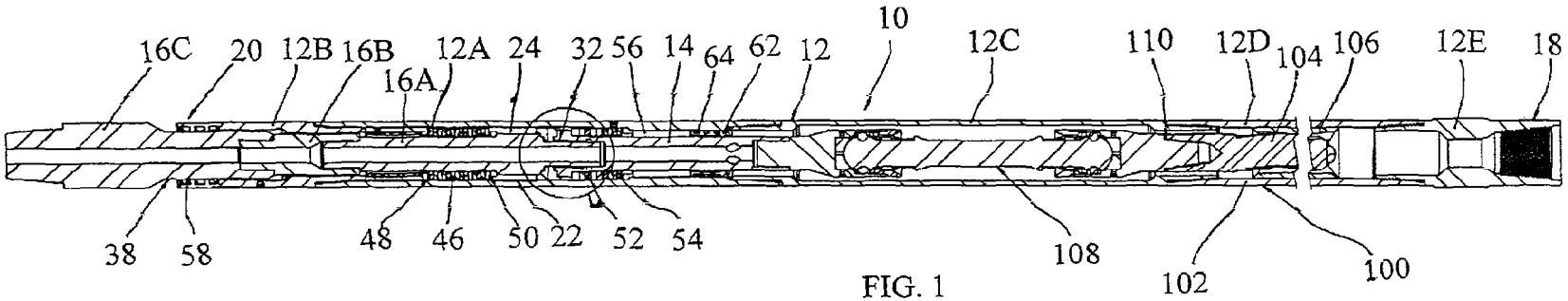
FIG. 1 is a side elevation view, in section, of a down hole apparatus for generating a pulsing action coupled to a down hole motor assembly.

A down hole apparatus for generating a pulsing action generally identified by reference numeral 10, will now be described with reference to FIG. 1 through FIG. 5.

Structure and Relationship of Parts:

Referring to FIG. 1, down hole apparatus 10 includes a tubular housing 12, a first mandrel 14 and a second mandrel 16.

Figure 3:
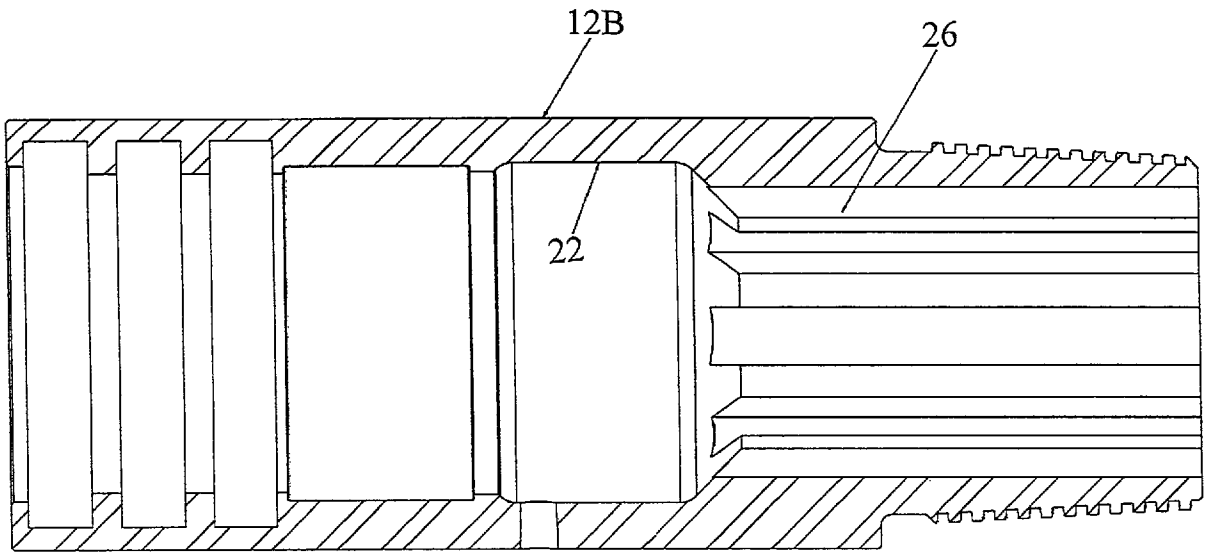
FIG. 3 is perspective view of an interior axial splined engagement at a second end of a housing component of the down hole apparatus for generating a pulsing action of FIG. 1.

Housing, generally indicated by reference numeral 12, has a first end 18, a second end 20, and an interior surface 22 defining an interior bore 24. For ease of fabrication and assembly, housing 12 is made up of several components: main housing 12A and splined housing 12B. With the preferred embodiment illustrated in FIG. 1, there is also a universal joint housing 12C, a stator housing 12D, and a top sub housing 12E. Splined housing 12B is positioned at second end 20 of housing 12. Referring to FIG. 3, interior surface 22 of splined housing 12B has an interior axial splined engagement 26.

Figure 2:
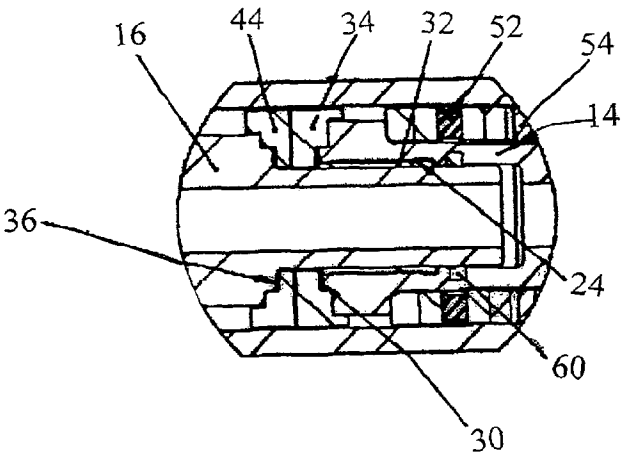
FIG. 2 is a detailed side elevation view, in section, of the down hole apparatus for generating a pulsing action of FIG. 1 taken from detail A.
Figure 5:
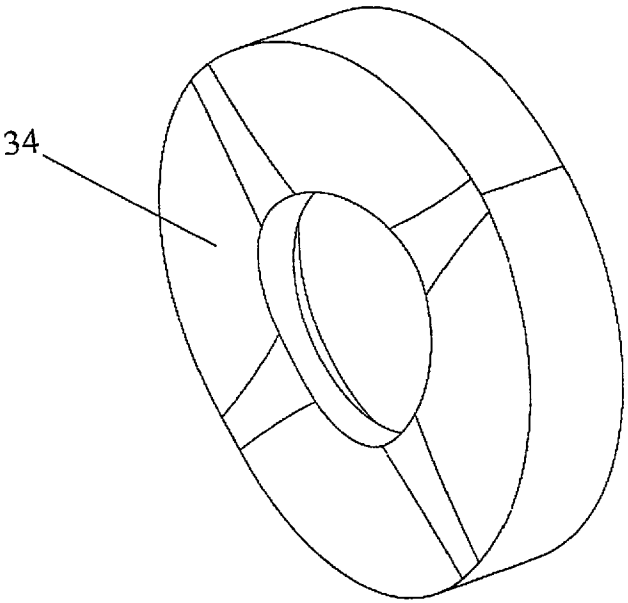
FIG. 5 is perspective view of a first cam component of the down hole apparatus for generating a pulsing action of FIG. 1.

Referring to FIG. 1, first mandrel 14 has a first end 28 and a second end 30. First mandrel 14 is journaled by radial bearings 32 for rotation within interior bore 24 at first end 18 of housing 12. Referring to FIG. 2, second end 30 of first mandrel 14 has a first cam profile 34. Referring to FIG. 5, first cam profile 34 is illustrated.

Figure 4:
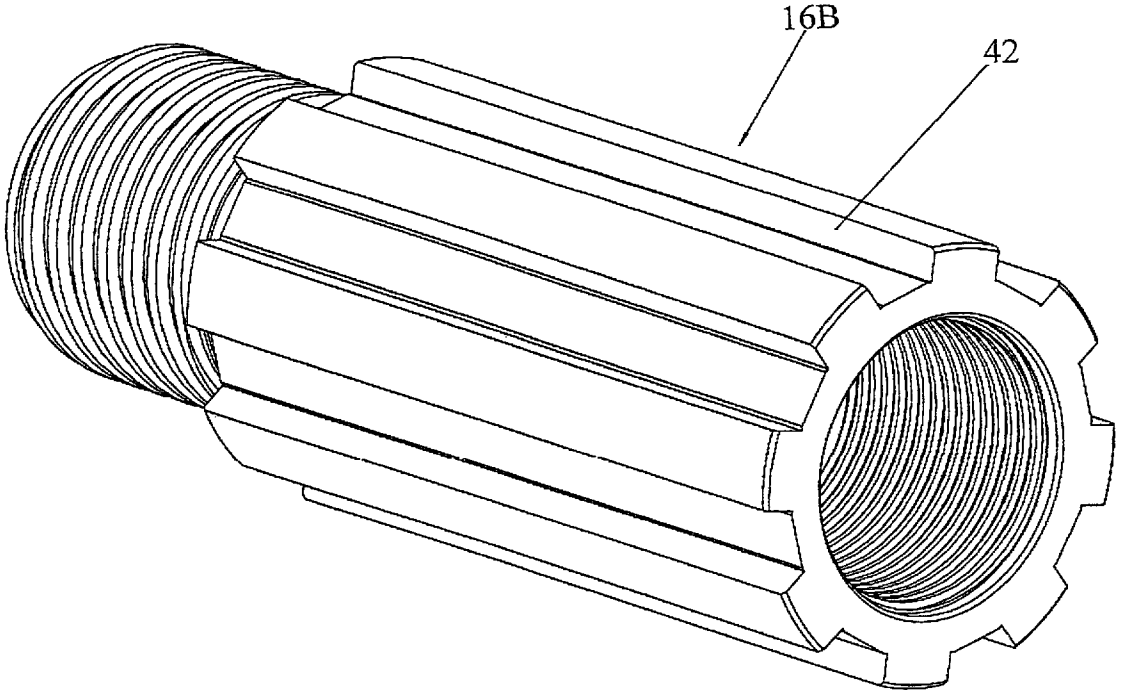
FIG. 4 is perspective view of a coupling component with an exterior axial splined engagement of a second mandrel of the down hole apparatus for generating a pulsing action of FIG. 1.

Referring to FIG. 1, second mandrel 16 has a first end 36, a second end 38 and an exterior surface 40. For ease of manufacture and assembly, second mandrel is made from several components: a main second mandrel 16A, a splined coupling mandrel 16B and a bottom sub mandrel 16C. Referring to FIG. 4, splined coupling mandrel 16B has an exterior axial splined engagement 42. Referring to FIG. 1, second mandrel 16 is positioned within interior bore 24 of housing 12 with exterior axial splined engagement 42 on splined coupling mandrel 16B engaged with interior axial splined engagement 26 on interior surface 22 of splined housing 12B. When exterior axial splined engagement 42 is engaged with interior axial splined engagement 26, second mandrel 16 is unable to rotate relative to housing 12 but able to move axially relative to housing 12. First end 36 of second mandrel 16 has a second cam profile 44. Referring to FIG. 2, first end 36 of second mandrel 16 engages second end 30 of first mandrel 14 in mating male to female engagement. When second mandrel 16 and first mandrel 14 are mated, second cam profile 44 engages first cam profile 34. Second cam profile 44 is similar to first cam profile 34 illustrated in FIG. 5, and has, therefore, not been separately illustrated.

Referring to FIG. 1 and FIG. 2, upon rotational movement of first mandrel 14, first cam profile 34 exerts an axial force upon second cam profile 44 initiating a pulsing action by forcing second mandrel 16 away from first mandrel 14. Belville springs 46 are positioned between an interior shoulder 48 on interior surface 22 of housing 12 and an exterior shoulder 50 on second mandrel 16 to apply a force biasing second mandrel 16 back toward first mandrel 14, thereby completing the pulsing action and maintaining second cam profile 44 engaged with first cam profile 34.

Referring to FIG. 1, in order to facilitate axial loading on down hole apparatus 10 thrust bearings 52 are provided which are preloaded by an upper grouping of belville springs 54. In order to keep abrasive drilling mud away from bearings and cam surfaces, portions of down hole apparatus 10 are sealed with seals to form a lubricant filled chamber 56. Seals 58 capable of withstanding relative reciprocating movement are positioned between exterior surface 40 at second end 38 of mandrel 16 and interior surface 22 at second end 20 of housing 12. Referring to FIG. 2, a seal 60 capable of handling rotational forces is positioned where rotating second end 30 of first mandrel 14 engages stationary first end 36 of second mandrel 16. Referring to FIG. 1, a pressure balancing piston 62 is provided which carries seals 64. Pressure balancing piston 62 moves in response to fluid pressure caused by drilling fluids pumped from surface. This places lubricant within chamber 56 under the same pressure as drilling fluids, so there is relatively less of a pressure differential for the seals to withstand. Pressure balancing piston also has a rotary seals 63 to seal interior of piston 62 relative to shaft 14.

In order for down hole apparatus to generate a pulsing action, first mandrel 14 must be rotated. There are various ways in which this can be done. There are down hole mud motors, down hole turbines, and electric drive motors. In FIG. 1, a preferred configuration is illustrated in which a down hole motor assembly, generally indicated by reference numeral 100, is incorporated into housing 12. Down hole motor assembly 100 is coupled to and used to impart a rotational force to first mandrel 14. Down hole motor assembly 100 includes a moineau motor 102 having a rotor 104 and stator 106, which is positioned within stator housing 12D. The operation of moineau motors is well known and will not be further described, except to say that rotor 104 rotates in response to passage of fluids through stator 106. A universal joint 108, positioned in universal joint housing 12C, is used to convert eccentric rotation of a remote end 110 of rotor 104 to concentric motion for input to first mandrel 14.

Operation:

The operation of down hole apparatus 10 will now be described. Referring to FIG. 1, drilling fluids pumped from surface pass into moineau motor 102 causing rotor 104 to rotate as the drilling fluids pass between rotor 104 and stator 106. This results in an eccentric rotation at remote end 110 of rotor 104. Universal joint 108 converts eccentric rotation of rotor 104 into concentric rotation, which concentric rotation is input into first mandrel 14. Rotation of mandrel 14 causes movement of first cam profile 34. First cam profile 34 exerts an axial force upon second cam profile 44 initiating a pulsing action by forcing second mandrel 16 away from first mandrel 14. Belville springs 46 positioned between interior shoulder 48 on interior surface 22 of housing 12 and exterior shoulder 50 on second mandrel 16 apply a force biasing second mandrel 16 back toward first mandrel 14, thereby completing the pulsing action and maintaining second cam profile 44 engaged with first cam profile 34.

It will be appreciated that apparatus 10 cannot be attached directly to a drill bit. Drill bits must rotate and apparatus 10 create a reciprocating motion, without an accompanying rotary motion. For this reason, apparatus 10 will normally be used in a drilling string in combination with a rotary turbine or a mud motor that is capable of rotating the drill bit.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A down hole apparatus for generating a pulsing action, comprising:

a tubular housing having a first end, a second end, and an interior surface defining an interior bore, the interior surface of the housing having an interior axial engagement at the second end;

a first mandrel having a first end and a second end, the first mandrel being journalled for rotation within the interior bore at the first end of the housing, the second end of the first mandrel having a first cam profile;

a second mandrel having a first end, a second end and an exterior surface having an exterior axial engagement, the second mandrel being positioned within the interior bore of the housing with the exterior axial engagement engaged with the interior axial engagement on the interior surface of the housing with the second mandrel unable to rotate but able to move axially relative to the housing, the first end of the second mandrel having a second cam profile, the second cam profile engaging the first cam profile, such that upon rotational movement of the first mandrel the first cam profile exerts an axial force upon the second cam profile forcing the second mandrel away from the first mandrel; and springs positioned between an interior shoulder on the interior surface of the housing and an exterior shoulder on the second mandrel to apply a force biasing the second mandrel toward the first mandrel, thereby maintaining the second cam profile engaged with the first cam profile.

2. The down hole apparatus for generating a pulsing action of claim 1, wherein a down hole motor assembly is coupled to and used to impart a rotational force to the first mandrel, the down hole motor assembly comprising:

a moineau motor having a rotor and stator, with the rotor rotating in response to passage of fluids through the stator; and a universal joint used to convert eccentric rotation of a remote end of the rotor to concentric motion for input to the first mandrel.

* * * * *